US005925879A

United States Patent [19]

Hay

[11] Patent Number: 5,925,879

[45] **Date of Patent: *Jul. 20, 1999**

[54] OIL AND GAS WELL PACKER HAVING FIBER OPTIC BRAGG GRATING SENSORS FOR DOWNHOLE INSITU INFLATION MONITORING

[75] Inventor: Arthur D. Hay, Cheshire, Conn.

[73] Assignee: CiDra Corporation, Wallingford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/853,402

[22] Filed: May 9, 1997

[51] Int. Cl.[6] ..... E21B 49/00

[52] U.S. Cl. ..... 250/227.14; 250/268; 250/231.19; 73/152.51

[58] Field of Search ..... 250/227.14, 227.15, 250/227.16, 227.18, 227.23, 231.19, 256–260, 268, 269.6; 73/152.05, 152.52, 152.53; 175/49, 50

[56] References Cited

U.S. PATENT DOCUMENTS

| | | |
|---|---|---|
| 4,761,073 | 8/1988 | Meltz et al. . |
| 4,806,012 | 2/1989 | Meltz et al. . |
| 4,898,236 | 2/1990 | Sask . |
| 4,950,883 | 8/1990 | Glenn . |
| 4,996,419 | 2/1991 | Morey . |
| 5,308,973 | 5/1994 | Odoni et al. . |
| 5,339,696 | 8/1994 | Carignan . |
| 5,353,637 | 10/1994 | Plumb et al. . |

(List continued on next page.)

FOREIGN PATENT DOCUMENTS

| | | |
|---|---|---|
| 0647764 | 4/1995 | European Pat. Off. . |
| 8503105 | 7/1985 | WIPO . |

OTHER PUBLICATIONS

W. W. Morey et al., "High Temperature Capabilities and Limitations of Fiber Grating Sensors", pp. 234–237, vol. 2360, Oct. 11, 1994, XP00060148, Proceedings of the SPIE.

M. G. Xu et al., "Fiber Grating Pressure Sensor with Enhanced Sensitivity Using a Glass–Bubble Housing", pp. 128/129, vol. 32, Jan. 18, 1996, XP000553416, Electronics Letters.

Huwen Gai, et al., "Monitoring and Analysis of ECP Inflation Status Memory Gauge Data", pp. 679–685, Oct. 22, 1996, XP002072648, SPE #36949.

*Primary Examiner*—Stephone Allen

*Attorney, Agent, or Firm*—Ware, Fressola, Van Der Sluys & Adolphson LLP

[57] ABSTRACT

The present invention features an apparatus comprising a packer means and a packer pressure sensing means. The packer means inflates to isolate zones in a well, such as an oil well or a gas well. The packer means responds to a material for inflating and providing a packer inflation pressure. The packer pressure sensing means responds to the packer inflation pressure, for providing a sensed packer inflation pressure signal containing information about a sensed packer inflation pressure when the packer is inflated to isolate zones in the oil or gas well. The packer pressure sensing means may include an internal fiber optic Bragg Grating sensor arranged inside the packer means, for providing the sensed internal packer inflation pressure signal. The packer pressure sensing means may also include an external fiber optic Bragg Grating sensor arranged outside the packer means, for providing the sensed external packer inflation pressure signal. The internal fiber optic Bragg Grating sensor and the external fiber optic Bragg Grating sensor may be either a Bragg Grating point sensor, multiple Bragg Gratings, or a lasing element formed with a pair or pairs of multiple Bragg Gratings.

13 Claims, 9 Drawing Sheets

U.S. PATENT DOCUMENTS 5,361,130 11/1994 Kersey et al. .
5,401,956 3/1995 Dunphy et al. .
5,426,297 6/1995 Dunphy et al. .
5,444,803 8/1995 Kim et al. .
5,451,772 9/1995 Narendran .
5,452,087 9/1995 Taylor et al. .
5,493,113 2/1996 Dunphy et al. .
5,493,390 2/1996 Varasi et al. .
5,495,892 3/1996 Carisella .
5,507,341 4/1996 Eslinger et al. .
5,513,913 5/1996 Ball et al. .
5,529,346 6/1996 Sperring .
5,564,504 10/1996 Carisella .
5,789,669 8/1998 Flaum ..... 73/152.51

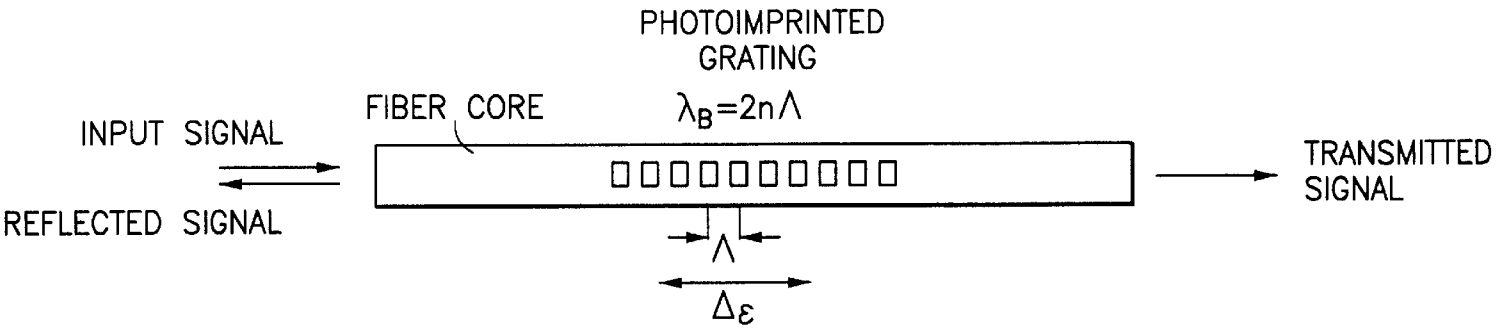
FIG.4(a)
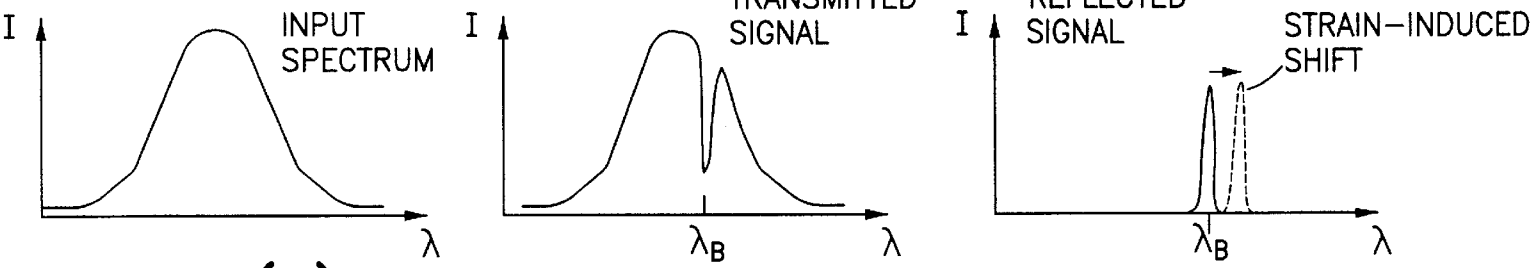
FIG.4(b)
FIG.4(c)
FIG.4(d)
$$\Delta\lambda=(1-p_{\Theta}i)\lambda\Delta\varepsilon \qquad p_{\Theta}=0.22$$
FIG.4(e)

OIL AND GAS WELL PACKER HAVING FIBER OPTIC BRAGG GRATING SENSORS FOR DOWNHOLE INSITU INFLATION MONITORING

TECHNICAL FIELD

The present invention relates to a packer used in a gas and oil well; and more particularly, relates to the monitoring of the inflation of such a packer to isolate zones in the gas and oil well.

BACKGROUND OF INVENTION

In the course of drilling an oil or gas well, the trajectory of the main well, or indeed a lateral well may intersect several independent formation pressure zones. Such zones may contain any combination of oil gas or water at different pressures, and as such have to be isolated from each other in order to control which zone is produced or not produced, and to prevent cross mixing between zones.

One method for achieving isolation is to deploy inflatable packers as part of the casing string and to inflate the packers, once they are in place, with cement pumped from the surface via special tooling that can be depth aligned with valves that allow the cement to enter into each independent packer. Although the pumping pressure is monitored at the surface, there are several potential leakage paths between the tool and the actual packer such that neither the volume nor pressure of the cement that enters the packer is known. If the packer is not adequately inflated and containment cannot be achieved, expensive rework or production difficulties may ensue.

Other than monitoring the actual pumping pressure or the volume of cement pumped, there is no attempt to monitor packer pressure during cementing operations.

In effect, permanent packers are inflatable systems which are inflated with cement pumped directly from the rig. A cementing tool with pressure or directional control cups is placed adjacent to the packer prior to pumping cement. The cups direct the cement via a check valve into the packer. The pumping pressure recorded at the surface together with the static head is assumed to be the pressure of the cement entering the packer. Improper positioning and leakage can significantly influence the packer pressure, but since there is no current instrumentation, the true value is never known.

SUMMARY OF INVENTION

The present invention has the object of providing a way to monitor internal and external packer pressure during the cementing operation.

The present invention features an apparatus comprising a packer means and a packer pressure sensing means.

The packer means inflates to isolate zones in a well, such as an oil well or a gas well. The packer means responds to a material for inflating and providing a packer inflation pressure.

The packer pressure sensing means responds to the packer inflation pressure, for providing a sensed packer inflation pressure signal containing information about a sensed packer inflation pressure when the packer is inflated to isolate zones in the oil or gas well.

The packer pressure sensing means may include an internal fiber optic Bragg Grating sensor arranged inside the packer means, for providing the sensed packer inflation internal pressure signal containing information about a sensed packer inflation internal pressure when the packer is inflated to isolate zones in the oil or gas well.

The packer pressure sensing means may also include an external fiber optic Bragg Grating sensor arranged outside the packer means, for providing the sensed packer inflation external pressure signal containing information about a sensed packer inflation external pressure when the packer is inflated to isolate zones in the oil or gas well.

The internal fiber optic Bragg Grating sensor and the external fiber optic Bragg Grating sensor may be either a Bragg Grating point sensor, multiple Bragg Gratings, or a lasing element formed with a pair or pairs of multiple Bragg Gratings.

With the actual individual packer pressure together with the volume of cement pumped the operator can anticipate improper inflation, leakage or formation collapse, in real time. Also knowing the actual zone pressure, i.e., the pressure between sets of ECPs packers, can give an early indication of zone leakage or interconnection between zones.

The foregoing and other objects, features and advantages of the present invention will become more apparent in light of the following detailed description of exemplary embodiments thereof, as illustrated in the accompanying drawings.

Figures includes FIGS. 4(*a*), 4(*b*), 4(*c*), 4(*d*) and 4(*e*).

FIG. 4(*a*) is an illustration of a photoimprinted Bragg Grating sensor.

FIG. 4(*b*) is a graph of a typical spectrum of an input signal to the photoimprinted Bragg Grating sensor in FIG. 4(*a*).

FIG. 4(*c*) is a graph of a typical spectrum of a transmitted signal from the photoimprinted Bragg Grating sensor in FIG. 4(*a*).

FIG. 4(*d*) is a graph of a typical spectrum of a reflected signal from the photoimprinted Bragg Grating sensor in FIG. 4(*a*).

FIG. 4(*e*) is an equation for the change of wavelength of the reflected signal shown in FIG. 4(*d*).

Figure 5B:
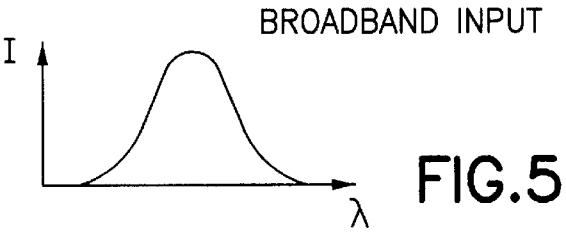
Figure 5A:
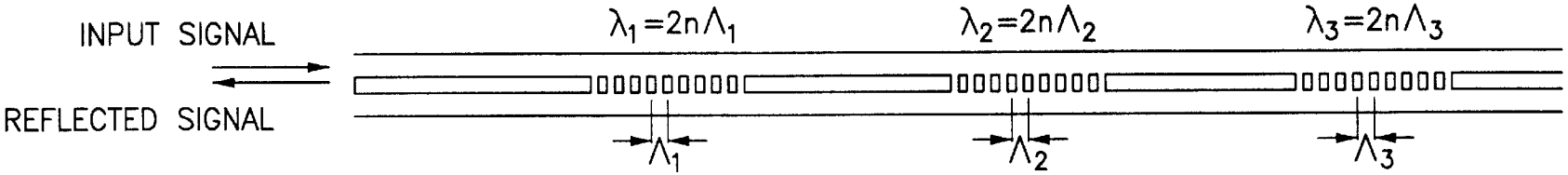
Figure 5C:
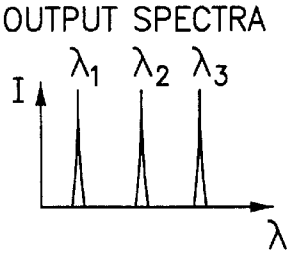

Figures includes FIGS. 5(*a*), 5(*b*) and 5(*c*) relating to wavelength division multiplexing of three Bragg Grating sensors.

FIG. 5(*a*) is an illustration of a series of three photoimprinted Bragg Grating sensors.

FIG. 5(*b*) is a graph of a typical spectrum of a broadband input spectrum to the three photoimprinted Bragg Grating sensors in FIG. 5(*a*).

FIG. 5(*c*) is a graph of output spectra of a reflected signal from the three photoimprinted Bragg Grating sensors in FIG. 5(*a*).

Figure 6:
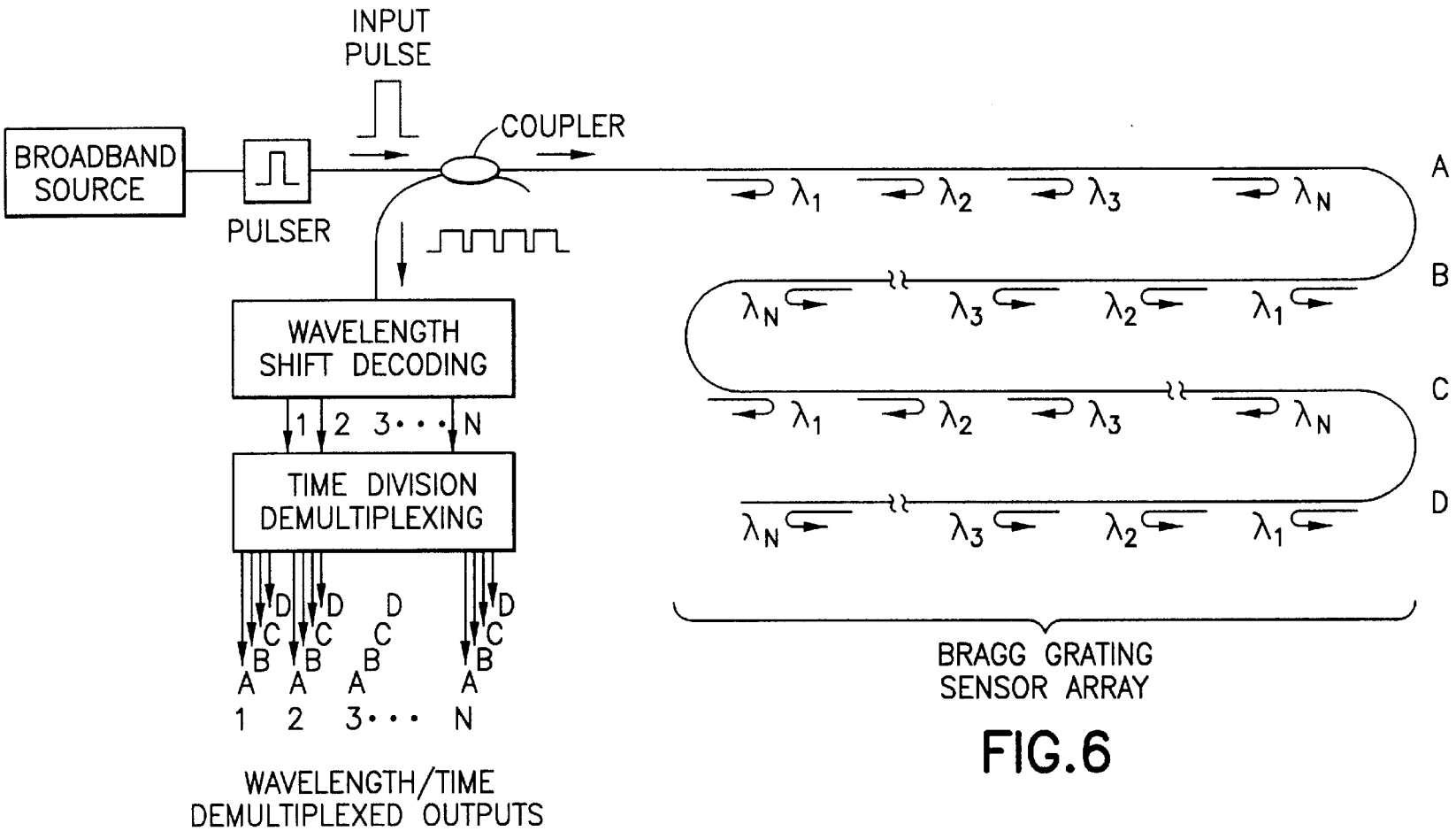

FIG. 6 includes is a time/wavelength division multiplexed Bragg Grating sensor array.

Figures 7A, 7B, 7C:
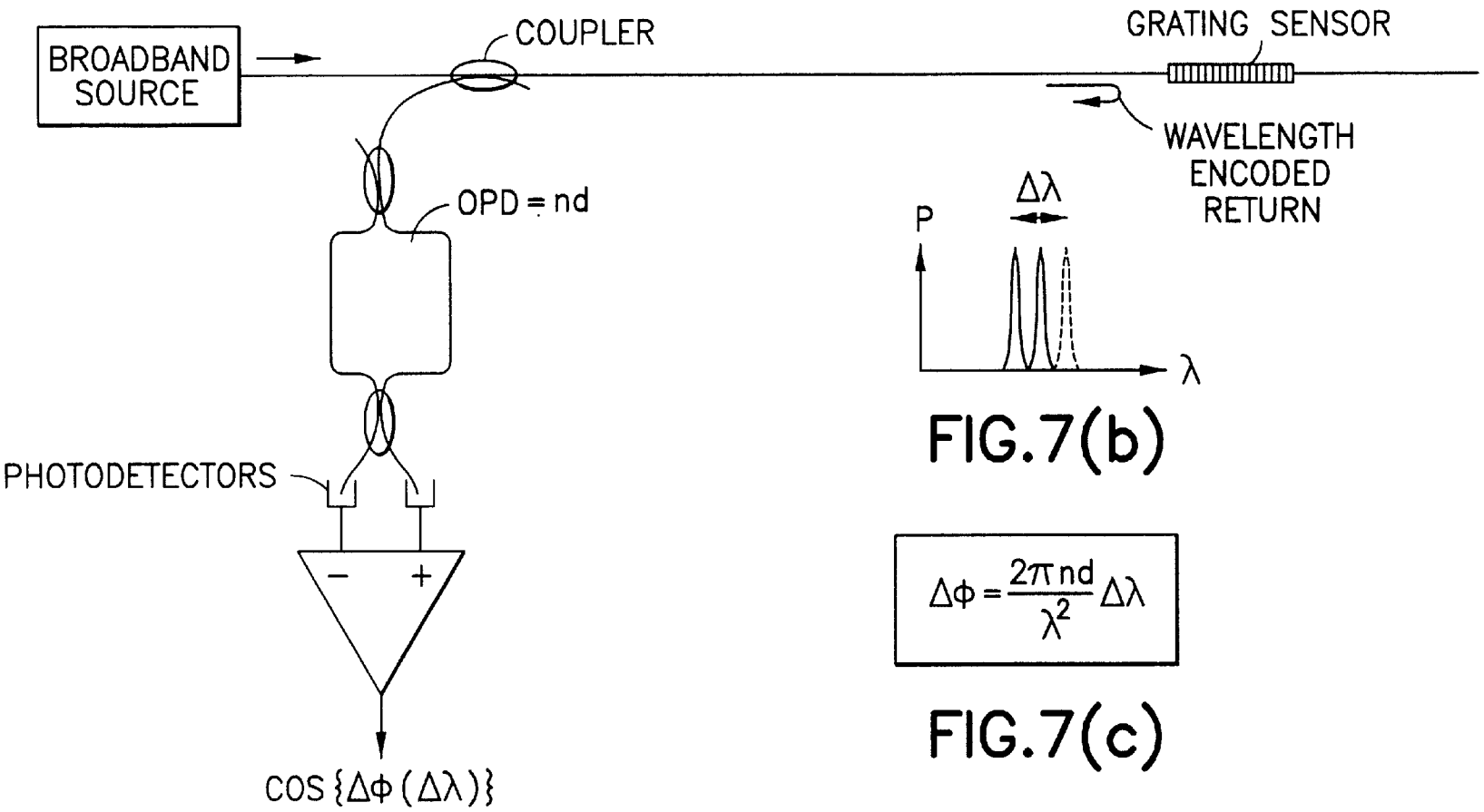

Figures includes FIGS. 7(*a*), 7(*b*) and 7(*c*).

FIG. 7(*a*) shows interferometric decoding of a Bragg Grating sensor.

FIG. 7(*b*) is a graph of output spectra of a wavelength encoded return signal from the Bragg Grating sensor in FIG. 7(*a*).

FIG. 7(*c*) is an equation for determining a wavelength shift transposed to a phase shift via interferometric processing of the wavelength encoded reflected signal shown in FIG. 7(*b*).

Figure 8:
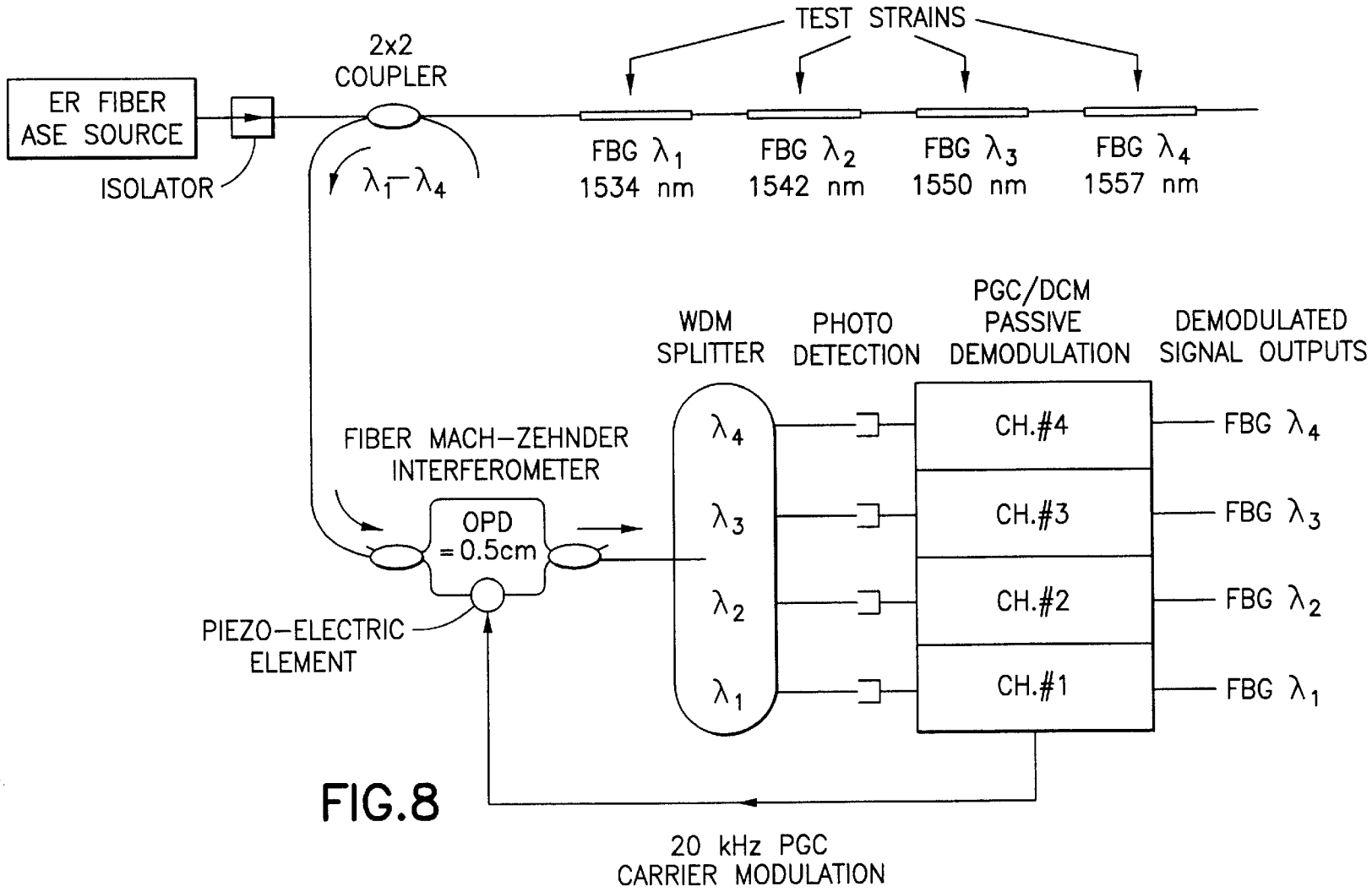

FIG. 8 shows an interferometrically decoded Bragg Grating sensor system.

Figure 9:
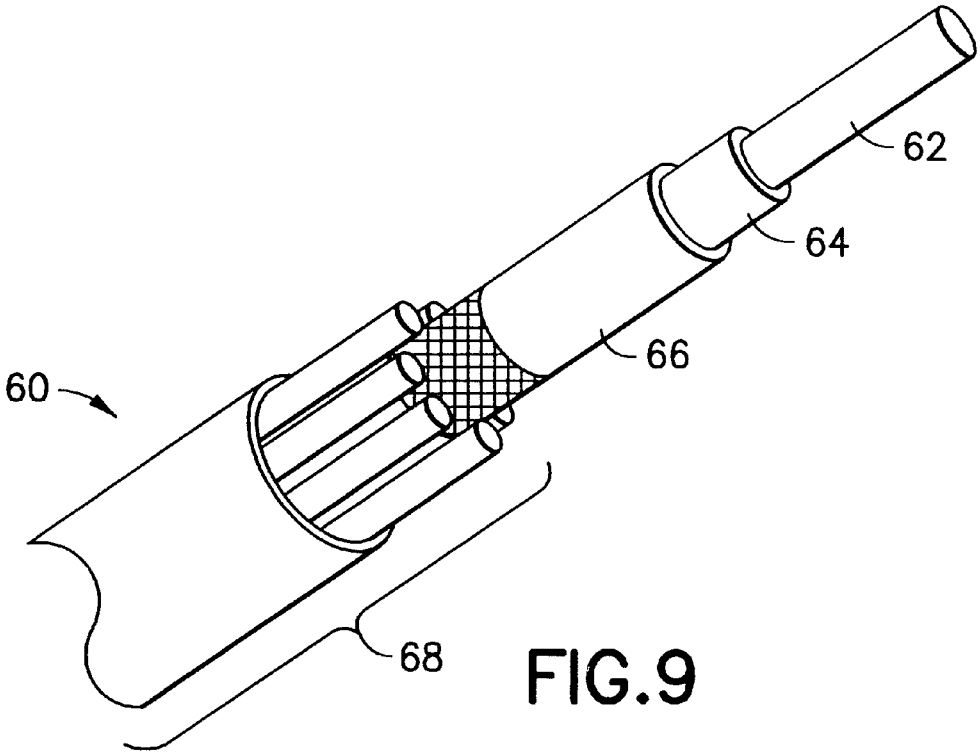

FIG. 9 is a diagram of a hermetic sealed fiber having a Bragg Grating internal to its core.

Figure 10:
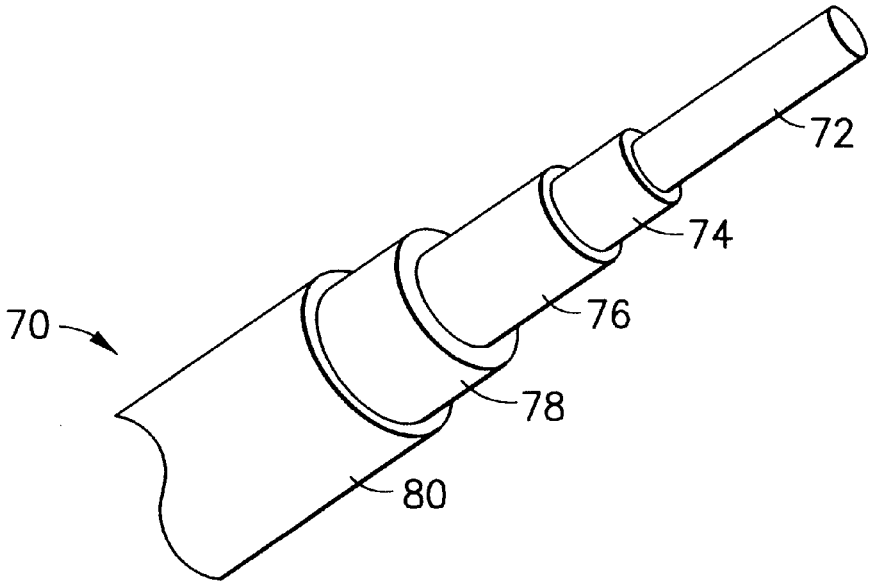

FIG. 10 is a diagram of a fiber in a capillarity having a Bragg Grating internal to its core.

DETAILED DESCRIPTION OF THE INVENTION

Figure 1:
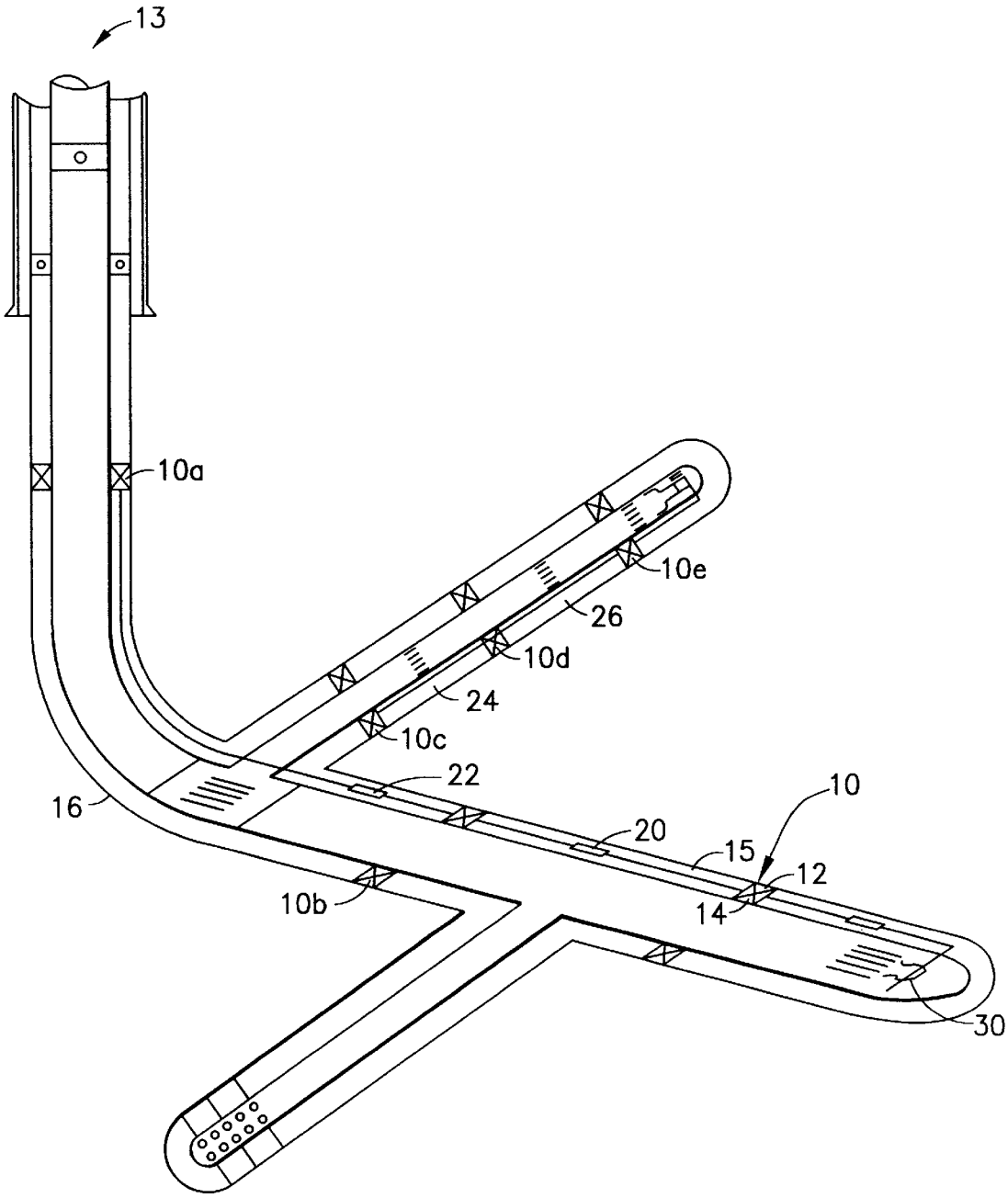
FIG. 1 is a diagram showing a production tubing having inflatable packers that are the subject matter of the present invention.
Figure 2:
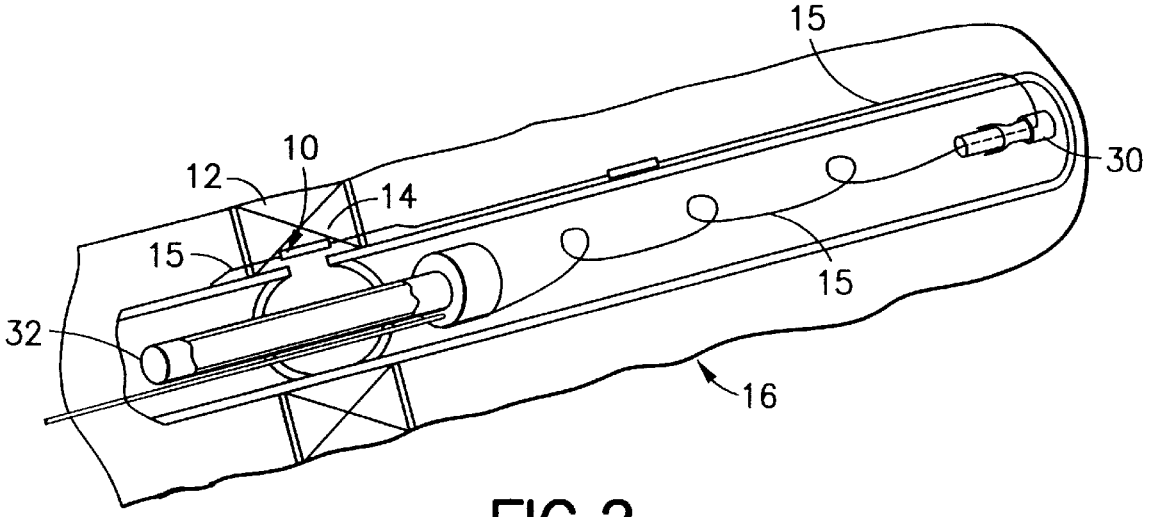
FIG. 2 is a diagram of one such inflatable packer.

Referring now to FIGS. 1 and 2, the present invention features an apparatus generally known as an isolation packer with Bragg Grating and generally indicated as 10 for the purpose of this discussion, comprising a packer means 12 and a packer pressure sensing means 14. The present invention is described with respect to the isolation packer with Bragg Grating 10 shown in FIG. 1. Other isolation packers with Bragg Gratings 10*a,* 10*b,* 10*c,* 10*d,* 10*e,* similar to the isolation packer with Bragg Grating 10, are shown but not described in further detail herein.

The packer means 12 are part of a production tubing 13 and are well known in the art, and the reader is referred to U.S. Pat. Nos. 5,495,892; 5,507,341 and 5,564,504, all hereby incorporated by reference. The packer means 12 inflates to isolate zones 1 and 2 in a well generally indicated as 16, such as an oil well or a gas well. The packer means 12 responds to a material such as cement for inflating and providing a packer inflation pressure. The scope of the invention is not intended to be limited to either any particular kind of production tubing 13, or any particular type of packer means 12 or inflating material.

The packer pressure sensing means 14 responds to the packer inflation pressure caused by the inflation of the packer means 12, for providing a sensed packer inflation pressure signal containing information about a sensed packer inflation pressure when the packer means 12 is inflated to isolate zones 1 and 2 in the oil or gas well. The packer pressure sensing means 14 is connected to a fiber 15 for providing the sensed packer inflation pressure signal to signal processing circuitry 50, shown and discussed with respect to FIGS. 3–8 below. A person skilled in the art would appreciate how to optically and/or mechanically connect the packer pressure sensing means 14 and the fiber 15, and the scope of the invention is not intended to be limited to any particular optical and/or mechanical connection therebetween.

The packer pressure sensing means 14 may include an internal fiber optic Bragg Grating sensor arranged inside the packer means 12, for providing a sensed packer inflation internal pressure signal. The packer pressure sensing means may also include an external fiber optic Bragg Grating sensor generally indicated as 20, 22, 24 arranged outside the packer means for providing a sensed external packer inflation pressure signal containing information about a sensed packer inflation external pressure when the packer means 12 is inflated to isolate zones 1 and 2 in the oil or gas well.

The internal and external fiber optic Bragg Grating sensors may be either a Bragg Grating point sensor, multiple Bragg Gratings, or a lasing element formed with a pair or pairs of multiple Bragg Gratings. The scope of the invention is not intended to be limited to any particular kind of Bragg Grating.

Figure 3:
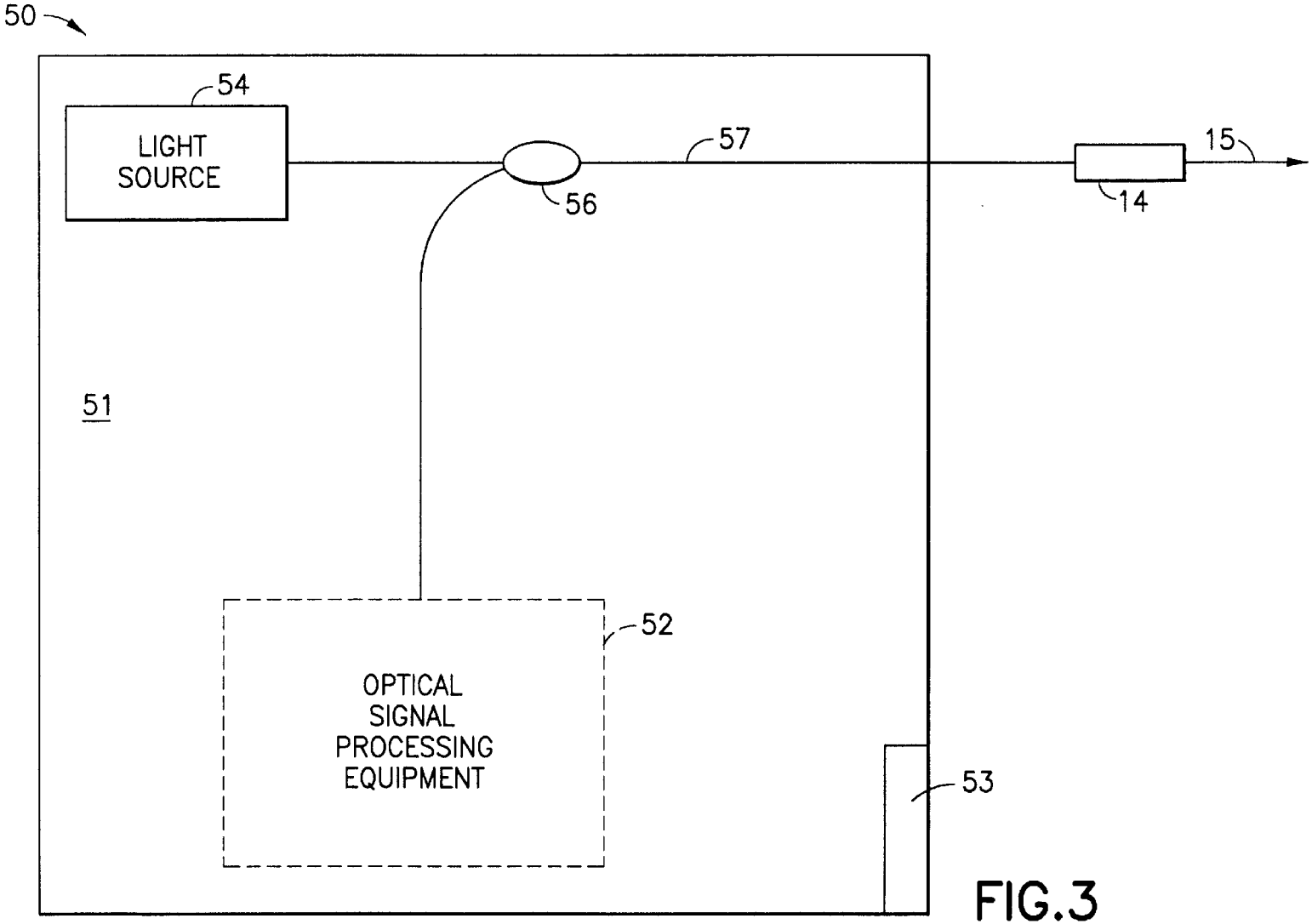
FIG. 3 is a diagram of signal processing circuitry that may be used with the present invention.

Referring now to FIG. 3, an example of signal processing circuitry is shown and generally indicated as 50 that may be used in conjunction with the present invention. The direct strain readout box 51 includes an optical signal processing equipment 52, a broadband source of light 54, such as the light emitting diode (LED) or laser, and appropriate equipment such as a coupler 56 connected to the fiber lead 57 for delivery of a light signal to the Bragg Grating sensor 14 (FIG. 1) in the packer (not shown in FIG. 3). In effect, the fiber optic lead 57 is coupled directly to the fiber 15, which in turn is connected to the internal and external fiber optic Bragg Grating sensors in the packer. The broadband source of light 54 provides an optical signal to the Bragg Gratings 20, where it is reflected and returned to the direct strain readout box 51 as a return light signal. The optical signal processing equipment 52 includes photodector measuring equipment to decode the wavelength shift and display the results as direct strain on the fiber optic Bragg Grating sensor depending upon the specific application, as discussed below. The optical coupler 56 provides the return light signal to the optical signal processing equipment 52 for analysis. The scope of the invention is not intended to be limited to any specific embodiment of the optical signal processing equipment 52. Other optical signal analysis techniques may be used with the present invention such as the necessary hardware and software to implement the optical signal diagnostic equipment disclosed in U.S. Pat. Nos. 4,996,419; 5,361,130; 5,401,956; 5,426,297; and/or 5,493,390, all of which are hereby incorporated by reference. See also U.S. Pat. Nos. 4,761,073; 4,806,012, 4,950,883; 5,513,913 and 5,493,113, hereby incorporated by reference. The direct strain readout box 51 can also have multiple leads for set-ups whereby there is more than one line of cable having fiber optic Bragg Grating sensors. Internal optical switching 53 in the direct strain readout box 51 allows each line of cable to be monitored in any sequence.

As is well known in the art, there are various optical signal analysis approaches which may be utilized to analyze return signals from Bragg Gratings. These approaches may be generally classified in the following four categories:

1. Direct spectroscopy utilizing conventional dispersive elements such as line gratings, prisms, etc., and a linear array of photo detector elements or a CCD array.

2. Passive optical filtering using both optics or a fiber device with wavelength-dependent transfer function, such as a WDN coupler.

3. Tracking using a tuneable filter such as, for example, a scanning Fabry-Perot filter, an acousto-optic filter such as the filter described in the above referenced U.S. Pat. No. 5,493,390, or fiber Bragg Grating based filters.

4. Interferometric detection.

The particular technique utilized will vary, and will depend on the Bragg Grating wavelength shift magnitude (which depends on the sensor design) and the frequency range of the measurand to be detected. The reader is generally referred to FIGS. 4–8, which would be appreciated by a person skilled in the art.

The Optic Fiber Bragg Grating Sensor 14

The invention is described as using fiber Bragg Gratings as sensors, which are known in the art. The Bragg Gratings may be a point sensor, and it should be understood that any suitable Bragg Grating sensor configuration may be used. For example, the Bragg Gratings can be used for interferometric detection. Alternatively, the Bragg Gratings may be used to form lazing elements for detection, for example by positioning an Ebrium doped length of optical fiber between a pair of Bragg Gratings. It will also be understood by those skilled in the art that the present invention will work equally as well with other types of sensors. The benefits of the present invention are realized due to improved sensitivity of transmission of force fluctuations to the sensors via the high density, low compressibility material.

As will be further understood by those skilled in the art, the optical signal processing equipment may operate on a principle of wave-division multiplexing as described above wherein each Bragg Grating sensor is utilized at a different passband or frequency band of interest. Alternatively, the present invention may utilize time-division multiplexing for obtaining signals from multiple independent sensors, or any other suitable means for analyzing signals returned from a plurality of Bragg Grating sensors formed in a fiber optic sensor string.

Basic Operation

In operation, in the present invention during the makeup of a typical packer downhole assembly the fiber optic Bragg Grating sensors are installed within each packer, as well as between each pair of packers and interconnected to a wet makeup fiber optic connector 30 which is installed centrally within a casing string for ease of make up to a coil tubing deployed fiber optic string. Such a string would be deployed integral to, or strapped on to a cementing tool 32 shown in FIG. 2. The head of such an assembly would be configured for two distinct operations, one to latch onto the individual packer locators, and the other to latch onto the fiber optic wet mateable connect 30. As the cementing tool 32 is withdrawn or moved to another packer position, the wet mateable fiber optic connector 30 remains securely in contact but the head of the cementing assembly would provide a fiber optic line 34 from a coil assembly located (not shown) within the head of the tool. Should the packer inflation sequence be from the shallowest to the deepest, then the tool would have to latch onto the wet connect 30 first, then pull back to the first packer.

Once connected, the wavelength dependent Bragg Grating or Gratings within each packer can be continuously interrogated to monitor change in pressure of each packer as it is inflated with cement. This reading can be displayed at the surface to facilitate the pumping operation of the cement.

In FIG. 1, each casing or external packer that is to be used for the completion should be fitted with a Bragg Grating sensor responsive to a known wavelength. The actual sensor element must be positioned so that it will be exposed to the cement that fills the packer cavity, the ends of the fiber must protrude beyond each end of the packer and be prepared for splicing. However, the scope of the invention is not intended to be limited to any particular location of the Bragg Grating or multiple Bragg Gratings within the packer.

As the bottom hole assembly is configured, the fiber optic Bragg Grating sensor is spliced both from the packers and the zones in an inline configuration and hooked up to the wet connect. The splices should be protected with the appropriate coatings in order to maintain the integrity of the fiber. Where there is significant distance between the packers, the fiber tube must be strapped to the casing. The configuration is surface tested to confirm integrity by shooting the fiber with broad band light and monitoring the response of each sensor. Similarly the wet connect should be prepared for downhole use according to the manufacturers' standard procedures.

The assembly can then be lowered downhole and secured in position ready for inflation. The second part of the operation is to inflate the packers with cement as shown in more detail in FIG. 2.

The cement tool 32 shown has a stainless steel tube banded to its outer diameter, and is modified to incorporate a reel (not shown) of fiber cable 34. The second half of the optical wet connect 30 is prepared and lowered downhole until it engages with the other half of the wet connect that is attached to the casing. When communication is achieved with the sensors located in the packers and zones, a lock-on condition is confirmed. The act of "locking on" also releases the fiber on the reel such that by simply pulling back up on the cement tool 32, the fiber 15 unreels behind the tool maintaining the link. In this way, several packers at different depths can be inflated by one trip of the cementing tool 32.

Once cementing is complete, the cementing tool 32 can be pulled up out of the borehole 16, leaving the fiber 15 in the borehole 16 as it can be designed to break at either the wet connect or the reel. Alternatively, the cementing tool 32 can be tripped to bottom to release the wet connect and then be removed. In the latter case, the fiber 15 would be removed with the cementing tool 32, and provided the integrity of the wet connect is maintained, a reconnect using another tool can be accomplished.

The above system can be used to monitor external casing or isolation packer pressure in real time whilst inflation is taking place. In another embodiment, a system similar to the above can also be used to deploy a capillary tube with an internal fiber to the furthest extremity of a borehole, or a lateral from that borehole, and having it latch onto a connector at the end of the casing.

The Bragg Grating may be deployed in a hermetically sealed tube or coating to protect the optical fiber and sensors from the harsh environment. FIG. 9 shows such a hermetically sealed tube generally indicated as 60, while FIG. 10 shows fiber in a capillary generally indicated as 60, both of which are known in the art. In FIG. 9, the hermetically sealed tube 60 has a silica core 62 having a Bragg Grating (not shown) arranged therein, a silica cladding 64, a carbon, metallic or polymer, hermetic seal coating 66, and optional combinations of braided parallel "E" or glass fiber support filaments encapsulated in epoxy or low modulus material 68. In FIG. 10, the fiber in capillarity 70 has a silica core 72 having a Bragg Grating (not shown) arranged therein, a silica cladding 74, a carbon, metallic or polymer, hermetic seal coating 76, a gel or polymer 78 between the fiber and the wall of the capillarity and stainless steel seamless welded capillarity tubing for hermetic sealing and fiber protection 80. The scope of the invention is not intended to be limited to any particular construction of the hermetically sealed tube 60 or the fiber in capillarity 70.

It will be understood that other tube configurations may also be used with the present invention, such as a "U" shaped tube, wherein both ends of the tube are above the surface of the borehole. Additionally, it will be understood that the tube may be provided in any desired configuration in the borehole, such as wrapped around the drill string, to place sensors in a desired location within the borehole.

Temperature Compensation

Due to various non-linear effects associated with materials, construction, etc., and to geometrical, tolerance, and other variations which occur during manufacturing and assembly, linear temperature compensation alone may not be sufficient to produce a linear sensor. Therefore, the device may be further characterized over temperature, allowing a correction of output for temperature by means of curve fitting, look-up table, or other suitable means.

Although the invention has been described and illustrated with respect to exemplary embodiments thereof, the foregoing and various other additions and omissions may be made therein and thereto without departing from the spirit and scope of the present invention.

I claim:

1. An apparatus comprising:

a packer means that inflates to isolate zones in a well, including an oil or gas well, responsive to a material for inflating the packer means, for providing a packer inflation pressure; and a packer pressure optical sensing means, responsive to the packer inflation pressure, and further responsive to an optical signal, for providing a sensed packer inflation pressure optical signal containing information about a sensed packer inflation pressure when the packer is inflated to isolate zones in the well.

2. An apparatus according to claim 1, wherein the packer pressure optical sensing means includes an internal fiber optic Bragg Grating sensor arranged inside said packer means, for providing a sensed packer inflation internal pressure Bragg Grating optical signal containing information about a sensed packer inflation internal pressure applied on the internal fiber optic Bragg Grating sensor when the packer means is inflated to isolate zones in the well.

3. An apparatus according to claim 2, wherein the internal fiber optic Bragg Grating sensor includes either a Bragg Grating point sensor, multiple Bragg Gratings, or a lasing element formed with a pair or pairs of multiple Bragg Gratings.

4. An apparatus according to claim 1, wherein the packer pressure optical sensing means includes an external fiber optic Bragg Grating sensor arranged outside said packer means, for providing a sensed packer inflation external pressure Bragg Grating optical signal containing information about a sensed packer inflation external pressure applied on the external fiber optic Bragg Grating sensor when the packer means is inflated to isolate zones in the well.

5. An apparatus according to claim 4, wherein the external fiber optic Bragg Grating sensor includes either a Bragg Grating point sensor, multiple Bragg Gratings, or a lasing element formed with a pair or pairs of multiple Bragg Gratings.

6. An apparatus according to claim 1, wherein the packer pressure optical sensing means includes an internal fiber optic Bragg Grating sensor arranged inside said packer means, for providing a sensed internal packer inflation pressure Bragg Grating optical signal containing information about a sensed internal packer inflation pressure applied on the internal fiber optic Bragg Grating sensor when the packer means is inflated to isolate zones in the well; and wherein the optical packer pressure sensing means includes an external fiber optic Bragg Grating sensor arranged outside said packer means, for providing a sensed external packer inflation pressure Bragg Grating optical signal containing information about a sensed external packer inflation pressure applied on the external fiber optic Bragg Grating sensor when the packer means is inflated to isolate zones in the well.

7. An apparatus according to claim 6, wherein either the internal fiber optic Bragg Grating sensor or the external fiber optic Bragg Grating sensor includes either a Bragg Grating point sensor, multiple Bragg Gratings, or a lasing element formed with pairs of multiple Bragg Gratings.

8. An apparatus according to claim 1, wherein the packer pressure optical sensing means is connected to a fiber for providing the sensed packer inflation pressure optical signal to signal processing circuitry.

9. An apparatus according to claim 1, wherein the packer pressure optical sensing means comprises a hermetically sealed tube.

10. An apparatus according to claim 9, wherein the hermetically sealed tube includes a silica core having a Bragg Grating arranged therein, a silica cladding, and a carbon, metallic or polymer, hermetic seal coating.

11. An apparatus according to claim 10, wherein the hermetically sealed tube also includes optional combinations of braided parallel "E" or glass fiber support filaments encapsulated in epoxy or low modulus material.

12. An apparatus according to claim 1, wherein the packer pressure optical sensing means comprises a fiber in a capillary.

13. An apparatus according to claim 12, wherein the fiber in the capillary has a silica core having a Bragg Grating arranged therein, a silica cladding, a carbon, metallic or polymer, hermetic seal coating, a gel or polymer between the fiber and the wall of the capillary and stainless steel seamless welded capillary tubing for hermetic sealing and fiber protection.

* * * * *

UNITED STATES PATENT AND TRADEMARK OFFICE

CERTIFICATE OF CORRECTION

PATENT NO : 5,925,879

DATED July 20, 1999

INVENTOR(S) : Arthur D. Hay

It is certified that error appears in the above-identified patent and that said Letters Patent is hereby corrected as shown below:

Title page,
item [73]:
Assignee:, please delete "CiDra Corporation" and insert --CiDRA Corporation--.

In column 2, line 34, please delete "Figures" and insert --Figure 4--.

In column 2, line 48, please delete "Figures" and insert --Figure 5--.

In column 2, line 62, please delete "Figures" and insert --Figure 7--.

Signed and Sealed this

Seventh Day of March, 2000

*Attest:*

Q. TODD DICKINSON

*Attesting Officer*

*Commissioner of Patents and Trademarks*